United States Patent [19]

Remes

[11] Patent Number: 4,475,348

[45] Date of Patent: Oct. 9, 1984

[54] METHOD AND APPARATUS FOR FILLING CRYOGENIC LIQUID CYLINDERS

[75] Inventor: Scott Remes, Prior Lake, Minn.

[73] Assignee: Minnesota Valley Engineering, Inc., New Prague, Minn.

[21] Appl. No.: 401,602

[22] Filed: Jul. 26, 1982

[51] Int. Cl.[3] ..... F17C 7/02

[52] U.S. Cl. ..... 62/55; 141/5

[58] Field of Search ..... 62/50, 51, 55; 141/5

[56] References Cited

U.S. PATENT DOCUMENTS

| | | | |
|---|---|---|---|
| 2,487,863 | 11/1949 | Garretson | 62/55 |
| 2,916,061 | 12/1959 | Hahn et al. | 62/51 |
| 2,993,343 | 7/1961 | Benz | 62/51 |
| 3,272,238 | 9/1966 | Groppe | 62/50 |
| 3,282,305 | 11/1966 | Antolak | 62/50 |
| 3,845,636 | 11/1974 | Van Mal et al. | 62/55 |

*Primary Examiner*—Ronald C. Capossela

*Attorney, Agent, or Firm*—McDougall, Hersh & Scott

[57] ABSTRACT

A method and apparatus are disclosed for filling a portable cryogenic liquid cylinder from a large stand tank. The invention employs a regulator valve to perform an automatic throttling function whereby the pressure in the liquid cylinder is maintained at a value slightly lower than the upstream pressure in the stand tank. This significantly reduces filling losses due to flashing.

5 Claims, 2 Drawing Figures

METHOD AND APPARATUS FOR FILLING CRYOGENIC LIQUID CYLINDERS

BACKGROUND OF THE INVENTION

This invention relates to a method and apparatus for filling cryogenic liquid cylinders. Typically a filling station will have a large storage tank, often referred to as stand tank, in which a fluid, such as oxygen, nitrogen, argon or carbon dioxide, is stored in liquid form. Portable cylinders, which are insulated to maintain the fluids in their liquid state, must be periodically refilled and transported to a place of use.

There exists a number of methods for filling cryogenic liquid cylinders from a stand tank. Most such methods incur filling losses in the range of 25–50% of what ultimately ends up in the cylinder. Because of this, the overall efficiency of such industrial gas distribution centers is typically between 80–95% which means that out of every 100 pounds delivered to the stand tank only 80–95 pounds gets sold to customers. Furthermore, to obtain even this efficiency requires that in some systems the filling operator be somewhat skilled and pay close attention to the filling operation.

A number of prior art systems have attempted to deal with these large filling losses. These systems include recirculating systems to prevent loss of flashed vapor, top filling the cylinder with pumps and pump aided pressure transfer systems. None of these is entirey satisfactory.

The recirculating system recirculates the flashed vapor generated when the liquid from the stand tank enters the liquid cylinder. Recirculating the flashed vapor back to the stand tank can result in a no loss system. However, there is a serious risk of contamination of the stand tank if a contaminated liquid cylinder is being filled. Further, a sophisticated operator is required because a pump is a necessary component of this system.

Top filling with a pump works only under ideal conditions wherein the plumbing between the stand tank and the liquid cylinder is precooled and the liquid cylinder is cold (that is, it has not been left empty for a period of days). Under typical conditions the cylinder must be blown down periodically to avoid losing pump prime or damaging the seals. Further, the operation takes ten to twelve minutes on average and requires a sophisticated operator to deal with the pump problems and maintenance.

Pump aided pressure transfer can be effective in reducing losses if the operator is skilled and takes the time to throttle the exhaust. However, this is difficult to optimize.

It is accordingly an object of the present invention to provide a method and apparatus for filling cryogenic liquid cylinders which significantly reduces filling losses.

A further object of the invention is to provide a low loss filling system which does not require a skilled operator and which is automatic in operation.

A further object of the invention is to provide a system which can attain over 95% filling efficiency without depending upon operator skill.

A further object of the invention is to maximize the transfer rate of cryogenic liquid while reducing or eliminating flash losses by minimizing the two phase flow that occurs when pressure of a saturated liquid is decreased.

Other objects and advantages of the invention will be apparent from the remaining portion of the specification.

DETAILED DESCRIPTION

Figures 1, 2:
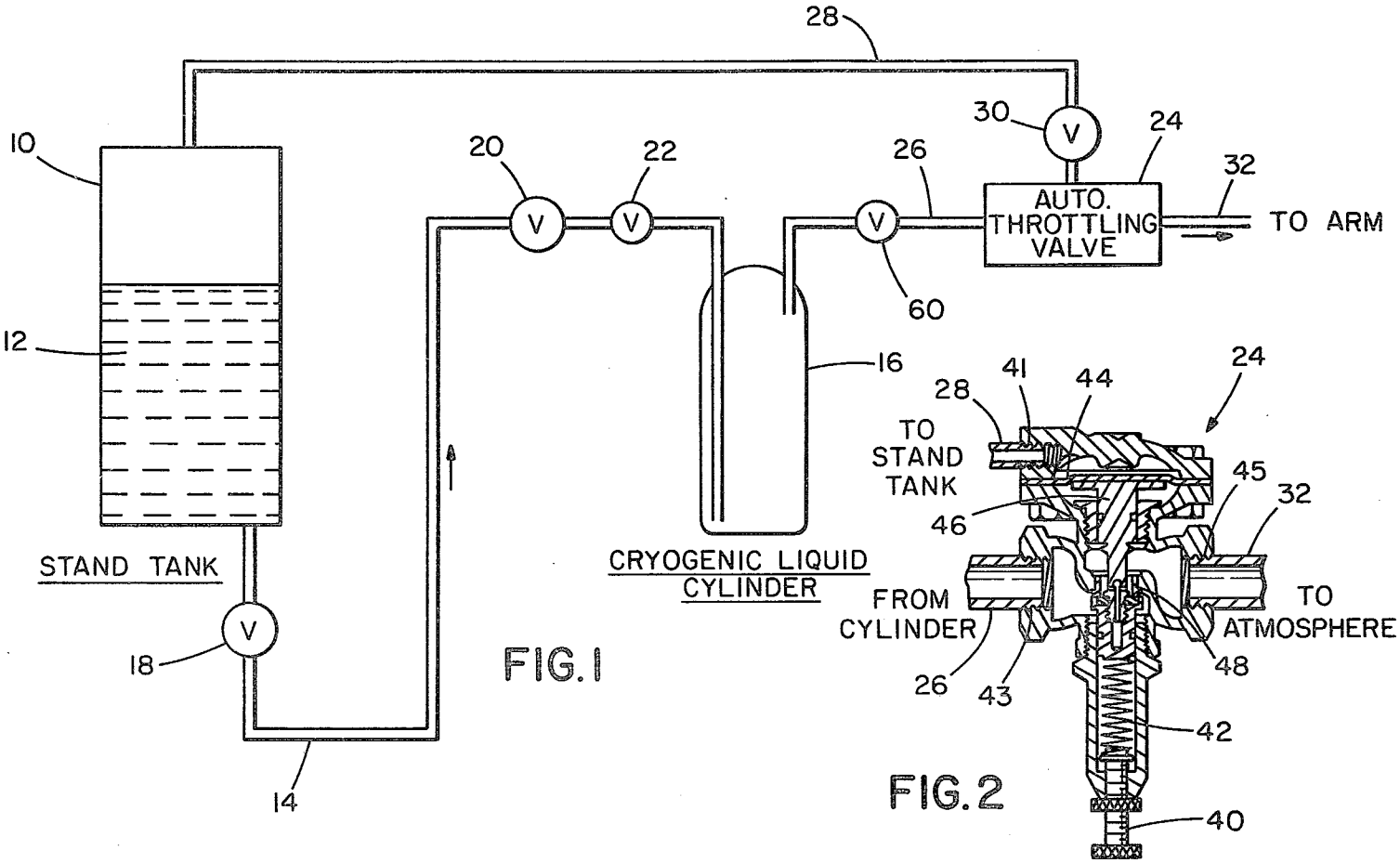
FIG. 1 is a schematic drawing of the system according to the invention.
FIG. 2 is a cross sectional view of the throttling valve employed in the invention.

As indicated in the background portion of the specification, the present system provides a way of filling cryogenic liquid cylinders which does not require operator skill and which is significantly more efficient than existing systems in terms of loss of fluid due to flashing, poor line insulation and related matters. Referring to FIG. 1, an installation according to the invention is illustrated. A storage or stand tank 10 is provided having a quantity of liquified gas 12 stored therein under cryogenic conditions. A pipe line 14 is connected to the tank at the bottom thereof for carrying the liquid to a filling station where a cryogenic liquid cylinder 16 is to be filled. Valves 18, 20 and 22 are provided in the line 14 for controlling the flow from the stand tank to the cylinder. Specifically, valve 18 is an isolation valve for the stand tank and should normally be open. Valve 20 is the valve which controls the liquid flow to the filling station. Valve 22 is the liquid valve on the liquid cylinder.

Since a principal object of the invention is to maximize liquid transfer to the cylinder while reducing losses, a first consideration of the system is to maximize the flow rate in the pipe line 14. For that purpose full port valves should be used for valves 18 and 20, such as ball or gate valves, and the pipe line 14 should be well insulated and kept as short as possible to maintain single phase flow through the transfer operation.

Empirically it has been determined that the heat influx to bare copper pipe lines is on the order of 40+/−20 BTU's per minute per foot. This should be reduced to 3 BTU's or less per minute per foot to effectively stop the vaporization of cryogenic liquid as it transfers through the pipe line. This can be accomplished using either vacuum jacketed pipe or PVC pipe foamed with a closed cell polyurethane foam. Vacuum jacketed pipe is preferred because the cool down losses are lower and the heat influx is lower. Also, it is a common characteristic of foam insulated piping systems to become saturated with water which is much worse than no insulation at all.

Maintaining single phase flow throughout the transfer operation is important because the mass flow rate of a liquid passing through a piping system at a specified pressure drop is significantly higher than the mass flow rate of a vapor passing through the same system at the same pressure drop.

To maintain single phase flow two steps are taken according to the invention. One is to properly insulate the pipe line 14 as just discussed. The second step is to maintain the system pressure above the saturation pressure of the liquid in the stand tank.

Empirically it has been determined that saturation pressure in a distributor's stand tank is normally 20 psi less than the actual tank pressure. The present invention provides an automatic throttling valve 24 which maintains approximately a 10 psi differential between the pressure in the stand tank and the liquid cylinder thus maintaining the pressure throughout the transfer system above the saturation pressure.

The value of approximately 10 psi has been empirically determined as representing an optimum compromise between filling time and filling losses. It is based on a typical installation. The important point is that the system pressure be maintained above or as close to the saturation pressure of the liquid in the stand tank as possible.

The manner in which this desired objective is obtained will now be described. An automatic throttling valve 24 is connected via piping 26 to the top portion of the cylinder 16. The valve is also connected via piping 28 to the top portion of the stand tank 10. A vapor shut off valve 30 is provided for servicing purposes. The throttling valve 24 has a pipe 32 connected thereto for venting vapor to the atmosphere in a manner to be described.

The automatic throttling valve functions to maintain the approximate 10 psi pressure differential between the vapor pressure in the stand tank and the pressure in the cylinder 16. The operation of this valve eliminates losses due to flashing of the liquid from the stand tank into a liquid cylinder which may be colder than the stand tank.

It is clearly desirable to eliminate these flash losses since they are the more significant portion of filling losses encountered in conventional systems. The automatic throttling valve 24, by maintaining 10 psi differential between the stand tank and the liquid cylinder, performs this task.

To appreciate the significance of this arrangement a brief review of filling difficulties is required. If the liquid cylinder is not vented during the filling process, filling would cease as soon as the pressure in the cylinder became equal to the pressure in the stand tank. On the other hand, if unrestricted venting is provided during filling, flashing would be excessive particularly if the incoming liquid is warmer than the liquid in the cylinder. Large quantities of liquid would vaporize and vent to the atmosphere.

The present invention automatically, without operator intervention, maintains optimal pressure in the cylinder to reduce flashing while still permitting sufficient venting that the filling operation can be completed. The approximate 10 psi differential is sufficient to permit filling of the cylinder from the stand tank while significantly reducing flashing losses.

The nature of the automatic throttling valve and its operation will now be discussed. As shown in FIG. 2, the valve is a vacuum regulator type. Such valves are commercially available and, for example, a Cash-Acme type D51 vacuum regulator, modified as described herein, is suitable for the purpose. Such a regulator includes an adjustment screw 40 for adjusting the compressive force of a coil spring 42 which acts to unseat the regulator at the set pressure. The regulator includes three ports for connecting lines thereto. The stand tank line 28 is connected to the upper port 41, the line 26 from the liquid cylinder is connected to the lower left hand port 43 while the vent line 32 is connected to the right hand port 45. As will be readily apparent to those skilled in the art, the vapor pressure of the stand tank is communicated via pipe line 28 to the upper port 41 of the regulator where it acts on a diaphragm 44 tending to seat a piston 46 at its sealing assembly 48. When the piston is seated vapor cannot flow from the port 43 through the regulator to the vent port 45.

Unseating the piston to permit vapor flow occurs whenever the pressure in the cylinder plus the force of the spring 42 exceeds the pressure from the stand tank. By adjusting the spring force with screw 40 the approximate 10 psi differential can be readily obtained.

With the valve thus set an automatic throttling function wherein the desired pressure differential is maintained occurs. No venting occurs until the pressure in the cylinder reaches approximately 10 psi less than the vapor pressure in the stand tank. At that point the piston is unseated by a variable amount sufficient to maintain the set pressure differential. This permits the vapor from the cylinder to vent to the atmosphere.

As previously indicated, the regulator is of a commercially available type modified, however, for cryogenic application. The changes, although minor, are as follows. The bolt and spring are of stainless steel. The diaphragm must be rated to withstand a maximum differential of approximately 250 psig. The valve seat has an increased radius of curvature to lengthen its life. The upper port 41 is restricted by use of an orifice to protect against blow down in the stand tank in the event of diaphgram failure.

From the foregoing description of the apparatus the operation of the invention will be apparent. For completeness, however, a brief operating description is provided. Initially the valve 18 is open, valve 20 being closed. A liquid cylinder to be filled is connected to the pipe line 14 in the manner indicated in FIG. 1 wherein the liquid enters the cylinder at the bottom thereof. The throttling system is also attached to the cylinder 16 by connecting pipe line 26 to communicate with the top portion of the cylinder. Filling begins simply by opening valve 20. Liquid flows through the pipe line 14 to the cylinder 16. Initially the valve 24 is closed and, therefore, as liquid enters the cylinder 16, pressure begins to build. When the pressure in the line 26 reaches a set point, approximately 10 psi less than the stand tank pressure, the valve unseats a variable amount sufficient to maintain the set point pressure differential. Tank filling proceeds rapidly with a minimum loss by virtue of this procedure. When the cylinder is filled valves 20 and 22 are closed and shortly thereafter the throttling valve seats. Valve 60 is closed and the cylinder is then disconnected and transported to its place of use.

Using the invention it has been found that filling losses can be reduced to the 2% to 10% range and that, by virtue of the simplicity of the system, a skilled operator is not required. The filling operation, once the valve 20 is open, is automatic. The optimum pressure differential is maintained throughout the transfer. This is a significant benefit over prior installations where gauges are provided which are usually inaccurate or damaged forcing an operator to guess at when and how to vent the cylinder.

While I have shown and described embodiments of this invention in some detail, it will be understood that this description and illustrations are offered merely by way of example, and that the invention is to be limited in scope only by the appended claims.

I claim:

1. A method of filling cryogenic containers with liquified gases from a storage tank to reduce losses comprising the steps of:

(a) connecting the container to the storage tank so that the liquid flows from the storage tank into said container;

(b) sensing the vapor pressures in the storage tank and the container;

(c) maintaining a selected vapor pressure differential between said tank and said container during filling by setting a throttling valve to vent vapor from said container to the atmosphere, the pressure in said container being less than the pressure in said tank, said valve automatically venting sufficient vapor to maintain said selected pressure differential.

2. The method according to claim 1 wherein the pressure differential of step (c) is selected so that the pressure in the container is above the saturation pressure of the liquid in the tank.

3. A system for filling containers with cryogenic liquids while reducing losses comprising:

(a) a cryogenic storage tank;

(b) means for conveying said liquids from said tank to said container;

(c) means for sensing the vapor pressures in said tank and said container and for maintaining a pressure differential between said container and said tank, the pressure in said container being less than the pressure in said tank, said sensing and maintaining means including (i) an automatic throttling valve which vents at a selectable pressure differential;

(ii) pipelines for communicating the container and tank pressures to said valve;

(iii) said valve including means for selecting the differential at which the valve begins to vent.

4. The system according to claim 3 wherein said conveying means includes an insulated pipeline and at least one full opening valve for controlling the flow of liquid from the tank to the container.

5. A system for filling containers with cryogenic liquids while reducing losses comprising:

(a) a cryogenic storage tank;

(b) means for conveying said liquids from said tank to said container;

(c) means for sensing the vapor pressures in said tank and said container and for maintaining a pressure in said container a selected amount below the pressure in said tank but above the saturation pressure of the liquid in the tank, said sensing and maintaining means including (i) an automatic throttling valve which vents at a selectable pressure differential;

(ii) pipelines for communicating the container and tank pressures to said valve;

(iii) said valve including means for selecting the differential at which the valve begins to vent.

* * * * *